US007470394B2

(12) United States Patent
Al-Shawi

(10) Patent No.: US 7,470,394 B2
(45) Date of Patent: Dec. 30, 2008

(54) FABRICATING HEATING ELEMENTS

(75) Inventor: Ibrahim Al-Shawi, Balham (GB)

(73) Assignee: Design Dynamics Limited, London (GB)

( * ) Notice: Subject to any disclaimer, the term of this patent is extended or adjusted under 35 U.S.C. 154(b) by 584 days.

(21) Appl. No.: 10/297,518

(22) PCT Filed: Jun. 4, 2001

(86) PCT No.: PCT/GB01/02481

§ 371 (c)(1),
(2), (4) Date: Jul. 3, 2003

(87) PCT Pub. No.: WO01/95671

PCT Pub. Date: Dec. 13, 2001

(65) Prior Publication Data

US 2004/0049907 A1 Mar. 18, 2004

(30) Foreign Application Priority Data

Jun. 6, 2000 (GB) ..... 0013777.8

(51) Int. Cl.
*B22F 3/02* (2006.01)
*H01C 1/02* (2006.01)

(52) U.S. Cl. ..... 419/66; 29/615

(58) Field of Classification Search ..... 419/38, 419/66; 53/409; 425/78
See application file for complete search history.

(56) References Cited

U.S. PATENT DOCUMENTS 2,973,527 A 3/1961 Oakley et al.
2,973,572 A * 3/1961 Oakley ..... 29/745
3,078,527 A * 2/1963 Valyi et al. ..... 164/464
3,315,334 A * 4/1967 Sterling ..... 29/611
4,190,407 A * 2/1980 Stroup et al. ..... 425/110
5,035,845 A * 7/1991 Gasiorek ..... 264/40.1
6,886,612 B2 * 5/2005 Duffield ..... 141/284
2001/0004137 A1 * 6/2001 Kouda et al. ..... 264/105

FOREIGN PATENT DOCUMENTS

DE 26 20 157 A1 11/1976
JP 63053392 A * 3/1988
JP 406321295 A * 11/1994

* cited by examiner

*Primary Examiner*—John P. Sheehan
*Assistant Examiner*—Jessee R. Roe
(74) *Attorney, Agent, or Firm*—Scully, Scott, Murphy & Presser, P.C.

(57) ABSTRACT

The present invention relates to a method and apparatus for producing heating elements in the form of tubes with a resistive heater therein, surrounded by refractory powder. A filling pipe is inserted into said tube, and powder is allowed to flow down said pipe. The pipe is moved upwardly, to allow powder to flow out, and then moved downwardly to rest on the powder. In a preferred form, the pipe is forced downwardly to further compact the powder, preferably by means of an impact with a hammer. Means may be provided to selectively grip the pipe to move it upwards, and the gripping means and the hammer can have a common drive mechanism. A valve may be provided to allow flow of powder into the pipe to be shut off when said tube is filled with powder.

24 Claims, 8 Drawing Sheets

FABRICATING HEATING ELEMENTS

BACKGROUND OF THE INVENTION

1. Field of the Invention

The present invention relates to a method and apparatus for use in the fabrication of heating elements, and more particularly to a method and apparatus for use in the fabrication of metal sheathed tubular electrical heating elements.

Electrical heating elements consisting of a coiled metallic wire fitted into a metallic tube and insulated from the tube by means of an insulating material are well known. They have a large number of applications, and are frequently used in immersion heaters, kettles, grills and the like.

2. Discussion of the Prior Art

There are several methods for manufacturing such elements, the most commonly used being the so-called "powder method". In this method, the coiled electrical heating element is positioned in an upright metal tube. The tube is then filled with a refractory insulating powder (commonly magnesium oxide, MgO), which ensures that the heating element is insulated from the tube. The tube can be vibrated during filling to consolidate the powder. After filling, the tube is sealed, with pins at the ends of the heating element projecting from the tube to allow electrical connection to be made. The tube is then subjected to a rolling, swaging or similar operation to reduce its cross-sectional area and to compact the insulating powder, increasing its density. A density of 3 g/cm$^3$ (3000 kg/m$^3$) is typical for magnesium oxide. During the rolling or other process, the tube work-hardens, and so it is necessary to anneal the tube to allow it to be bent into the desired shape, in order for it to be assembled into the finished article.

It will be appreciated that this method includes a number of separate steps, and so can take some time. Further, the annealing step in particular involves high temperatures, and consumes a large amount of energy. It would be desirable to reduce the number of steps required to manufacture an element, and to omit the annealing step if possible.

SUMMARY OF THE INVENTION

According to a first aspect of the present invention, there is provided a method of filling a tube with a powder, comprising the steps of:

i) positioning said tube generally vertically;

ii) inserting a filling pipe into said tube;

iii) allowing powder to flow into said filling pipe;

iv) moving said filling pipe upwardly a small distance to allow powder to flow from its lower end into said tube;

v) moving said filling pipe downwardly to rest on the powder in said tube;

vi) repeating steps (iv) and (v) until the tube is filled with powder; and vii) stopping further flow of powder into said pipe.

This method allows a heating tube to be filled with refractory powder quickly and reliably. Further, as the filling pipe rests on the powder in the tube, the weight of the filling pipe acting on the powder serves to compress it.

In addition, the method provides for feedback. As the filling pipe is withdrawn step-by-step from the tube, at each step it is positioned slightly higher, as it is resting on the newly-deposited powder. If the supply of powder to the pipe is cut off for any reason (for example, if the pipe becomes blocked), then the upward motion stops, and an operator implementing the method can be alerted by this.

Preferably, the filling pipe is urged against the powder after being moved downwardly in step (v) so as to compact the powder in said tube. This provides a more positive compression than merely having the weight of the filling pipe acting on the powder.

In a further preferred form, the pipe is pushed downwardly by means of an impact. This provides a very positive compression of the powder. Indeed, the compaction of the powder caused by the repeated impacts can be sufficient to allow the subsequent rolling step described above with reference to the prior art to be dispensed with.

Of course, any suitable means can be provided to move the pipe upwardly and downwardly. For example, the pipes can be suspended from a ceiling and raised and lowered as required. However, it is preferred for the pipe to be moved upwardly and downwardly by means of a grip mechanism, which can selectively grip said pipe.

With this arrangement, up-and-down motion of the grip serves to move the pipe while it is gripped. Further, because the grip can move relative to the pipe, it can move down the pipe after the pipe has been moved upwardly. The grip can thus remain in generally the same position relative to the tube being filled, but can oscillate up and down, the upward motion raising the pipe, and at least part of the downward motion being relative to the tube.

In a preferred form, the impact is achieved by impacting a hammer member on the grip mechanism while the grip is gripping the pipe. While it is possible to impact the hammer on the end of the filling pipe, this carries an increased risk of buckling the pipe. Further, if the hammer impacts on the grip, then it (like the grip) can remain in generally the same position relative to the tube being filled.

Preferably, the grip is forced to move relative to the pipe after impact, and it is preferred that the distance which the grip is forced to move relative to said pipe is controlled by feedback from the filling and compacting process itself, in that the distance which the grip moves relative to the pipe is determined by the thickness of compacted powder deposited in the previous cycle and the density to which it is compacted.

The grip and hammer can be moved in any convenient manner. However, in a preferred form, the grip and the hammer are mounted in a frame, said frame being driven to move up and down, the movement of the frame causing motion of the grip mechanism and the hammer.

It is also preferred that the design of the dynamics of motion of said hammer allows the impact required to compact powder not to be felt by said frame. This allows the frame to be constructed less robustly, with concomitant reductions in the weight of the machinery, the power needed to drive it, and the cost.

It is preferred for the flow of powder in step (iii) to commence with vibration of said filling pipe and to cease when vibration of said filling pipe ceases. Thus, powder only flows into the pipe when it is being vibrated by the action of the grip and the hammer (or whatever apparatus is being used to lift the pipe).

Preferably, the rate of powder flow in step (iii) is controlled by vibration characteristics of the filling apparatus, as well as by flow characteristics of the powder itself. This allows the rate of powder flow to be adjusted to match the required characteristics.

Preferably, the flow of powder is stopped in step (vii) by means of a valve actuated by upward motion of the filling pipe. As mentioned above, the filling pipe is gradually vertically withdrawn from the tube as it is filled. Once the tube is filled to the desired level of compacted powder, the top of the filling pipe can be used to actuate the valve, and this simplifies the construction of the apparatus used to implement the method.

Preferably, a hopper for powder is connected to the top of the filling pipe, upward motion of said hopper serving to actuate the valve.

Further, the idea of using a hammer to compress the powder is considered to be of independent inventive significance, and so according to a further aspect of the invention, there is provided a method of filling a tube with a powder, comprising the steps of:

i) positioning said tube generally vertically;

ii) inserting a filling pipe into said tube;

iii) allowing powder to flow into said filling pipe;

iv) moving said filling pipe upwardly a small distance by means of a grip mechanism to allow powder to flow from its lower end into said tube;

v) moving said filling pipe downwardly by means of said grip mechanism to rest on the powder in said tube;

vi) impacting said grip member with a hammer so as to compact the powder beneath the filling pipe;

vii) repeating steps (iv), (v) and (vi) until the tube is filled with powder; and viii) stopping further flow of powder into said pipe.

This method has the advantage over the prior art that the subsequent rolling step can be dispensed with. Further, it also provides feedback, as in the first aspect of the invention.

Preferably, the grip and the hammer are mounted in a frame which is driven cyclically up and down, the motion of the frame causing motion of the grip mechanism and the hammer. This has advantages as discussed previously.

The invention also extends to apparatus for filling a tube with a powder, and thus according to another aspect of the invention, there is provided apparatus for filling a tube with a powder, comprising:

means for supporting a tube to be filled;

a filling pipe into which powder can flow;

a mechanism for moving said filling pipe upwardly to allow powder to flow into said tube; and a mechanism for moving said filling pipe downwardly to rest on the powder in said tube.

As discussed above with reference to the method of filling the tube, this apparatus has the advantages of providing a degree of consolidation of powder in the tube, and also of providing feedback. If the filling pipe stops moving upwardly, then this is an indication to the operator of the apparatus that there is something amiss. This is particularly clear if a number of apparatuses are provided side by side, as the cessation of motion of one filling pipe is more obvious if the others are still moving.

It is preferred for the apparatus to comprise means for pushing the pipe downwardly against the powder in order to compress it. Of course, the greater the degree of compression of the powder achieved during the filling process, the less need there is for a subsequent rolling step. If the degree of compaction achieved during filling is sufficiently high, then the rolling step can be dispensed with altogether.

Preferably, there is a single mechanism for moving the filling pipe upwardly and downwardly, as this simplifies the apparatus. It is preferred for the mechanism to be in the form of a grip mechanism, which can be moved up and down and can selectively grip the filling pipe. As discussed above with reference to the filling method, this allows the grip to remain in substantially the same place relative to the rest of the apparatus while the pipe moves. This simplifies the apparatus in comparison to one where the grip mechanism must be raised with the pipe.

Preferably, the grip is held in a frame which is driven to move up and down, the movement of the frame causing the grip to move upwardly and downwardly. It is particularly preferred for the frame to comprise a member which pushes the grip upwardly during upward motion of the frame and pulls the grip downwardly during downward motion of the frame, wherein the upward motion of the grip moves the filling pipe upwardly and allows powder to flow from the pipe into the tube, and the downward motion of the grip pushes the pipe against the powder in the tube. This provides a simple construction which allows the pipe to be moved up and down, and to compress the powder in the tube.

As the step of pulling the pipe down onto the powder may not provide a sufficient degree of compaction, it is preferred for the apparatus to also comprise a hammer member, mounted in the frame. This hammer can be used to further compact the powder.

In a preferred form, the hammer is mounted on springs, such that the up and down motion of the frame causes said hammer to move up and down, the hammer impacting on the grip mechanism after the pipe has been pushed against the powder in the tube, this impact serving to compact the powder in the tube. This provides advantages as discussed above.

Preferably, the impact forces required to compact said powder are not transferred to said frame by virtue of the dynamics of motion of said hammer, and this also provides advantages as were discussed above with reference to the method.

Once again, the provision of a filling apparatus with a hammer is considered to be of independent inventive significance, and so according to a further aspect of the invention there is provided an apparatus for filling a tube with a powder, comprising:

means for supporting a tube to be filled;

a filling pipe into which powder can flow;

a mechanism for moving said filling pipe upwardly to allow powder to flow into said tube;

a mechanism for moving said filling pipe downwardly to rest on the powder in said tube; and a hammer for supplying an impact force to said filling pipe when it rests on the powder in said tube.

Again, it is preferred for the mechanism and the hammer to be mounted in a frame which is connected to a drive member enabling it to be driven in a cyclic up-and-down motion, the hammer being mounted in the frame on springs, such that the up and down motion of the frame causes the hammer to move up and down and to supply an impacting force to the pipe.

Preferably, a hopper for powder is connected to the upper end of the filling pipe. This ensures that there will be a sufficient supply of powder into the filling pipe.

It is preferred for the hopper to include a valve such that powder flow will commence with vibration of said filling pipe and will cease when vibration of said filling pipe ceases. As mentioned above, this ensures that powder will only flow into the filling pipe when the apparatus is in use and the pipe is vibrating. Once the apparatus is shut off and the pipe ceases to vibrate, the flow of powder also ceases, which allows the hopper to be recharged.

Preferably, as discussed with reference to the method, the rate of powder flow through said valve is controlled by the vibration characteristics of the filling apparatus hopper as well as by flow characteristics of the powder.

It is preferred for the valve to be provided in the lower region of the hopper, with at least one orifice formed therein in communication with the inside of the filling pipe, the orifice being at least partially defined by an upper surface and a lower surface, the upper surface which defines the passage extending laterally further into the bulk of the powder than the lower surface. It is this feature of the upper surface extending further than the lower surface that allows the valve to function in the desired manner.

Preferably, the hopper includes a shut-off valve for preventing flow of powder into the pipe after the tube has been filled, said valve being actuated by upward motion of said hopper.

Although flow into the pipe should cease when the vibration of the apparatus ceases, it is possible for vibration to continue after the tube is filled. For example, if the apparatus includes a number of tubes, and thus a number of filling pipes, it is quite possible that the tubes will not all reach their filled state simultaneously. Clearly, once a tube has been filled, it is desirable to prevent further flow into it, but it is also necessary to allow powder to continue to flow into the tubes which are not yet full. The provision of a shut-off valve allows flow into the filled tubes to cease while not interrupting flow into the tubes which are not full.

Preferably, the valve comprises a valve body in the bottom of the hopper, and a valve sleeve movably mounted in the hopper, upward motion of the hopper after said tube is filled serving to push the valve sleeve down into the valve body to close the valve. Thus, the valve is only actuated when the tube is full.

In a preferred form, the shut-off valve and said valve such allowing powder flow to commence with vibration of said filling pipe and cease when vibration of said filling pipe ceases are one and the same.

Further, the valve itself is also considered to be of independent inventive significance, and so according to a still further aspect of the invention, there is provided a valve for controlling the flow of powder or other fluent material therethrough, powder flow commencing with vibration of the valve and ceasing when vibration of the valve ceases, wherein the valve comprises a valve body provided in the lower part of a vessel for containing fluent material and having at least one orifice formed therein allowing communication with the outside of the vessel, the orifice being at least partially defined by an upper surface and a lower surface, the upper surface which defines the passage extending laterally further into the bulk of the fluent material in the vessel than the lower surface.

BRIEF DESCRIPTION OF THE DRAWINGS

A preferred embodiment of the invention will now be described by way of example only and with reference to the accompanying drawings, in which.

DETAILED DESCRIPTION OF PREFERRED EMBODIMENTS

Figure 1:
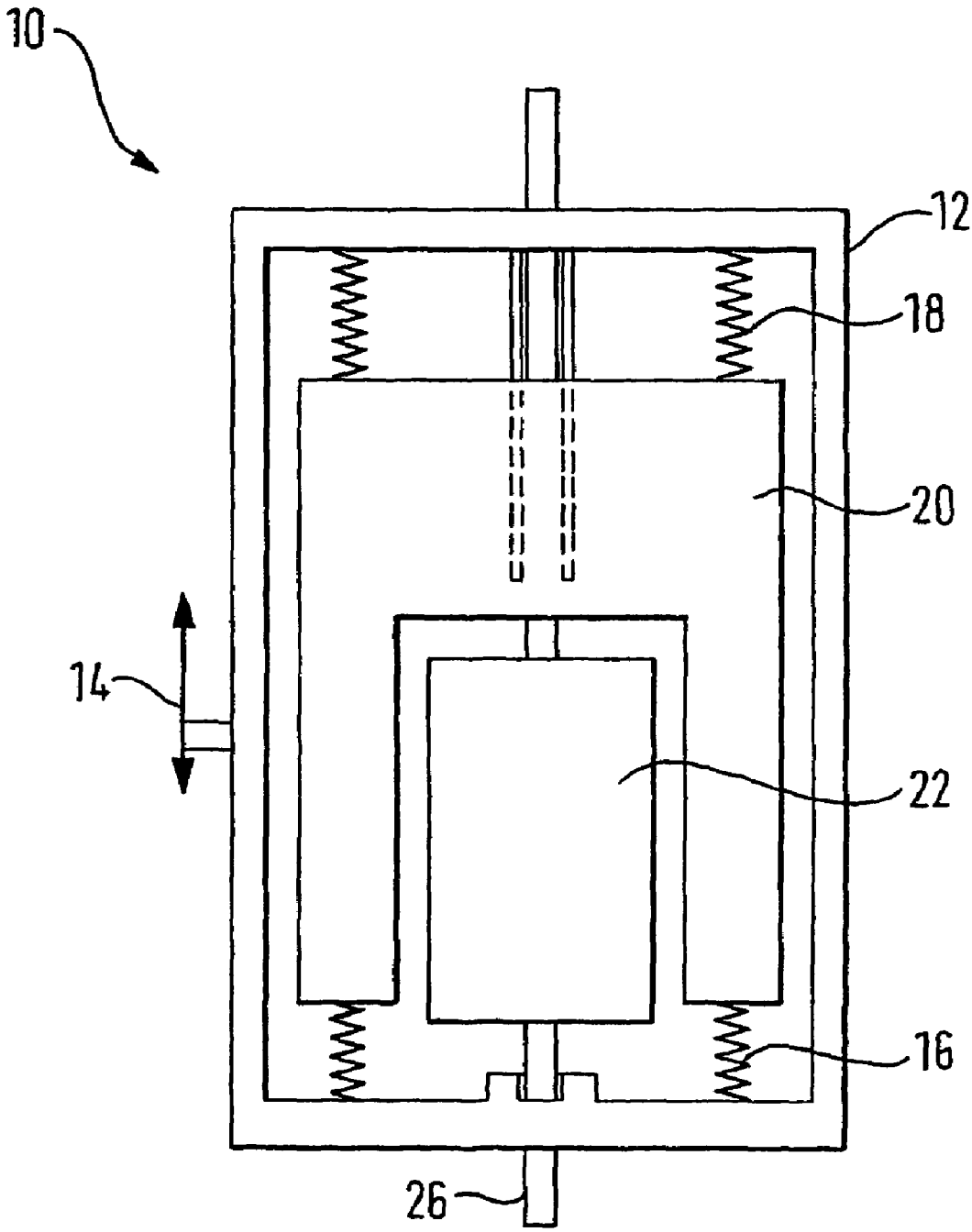
FIG. 1 is a schematic view of a part of a tube filling apparatus used in a filling machine.

Referring now to FIG. 1, a part 10 of the apparatus for filling a tube, referred to hereinafter as the "hammer-grip assembly", will be described in broad terms. The hammer-grip assembly 10 comprises a frame 12 which is connected to a drive mechanism 14, which imparts a up-and-down movement to the frame. The movement may be sinusoidal, but other forms of up-and-down movement may also be used. Supported in the frame 12 by means of springs 16, 18 is a hammer member 20, which, as can be seen from FIG. 1, has a cross-sectional shape generally in the form of an inverted "U". Between the arms of the "U" is a grip mechanism 22, the purpose of which will be described in more detail below.

Figure 2:
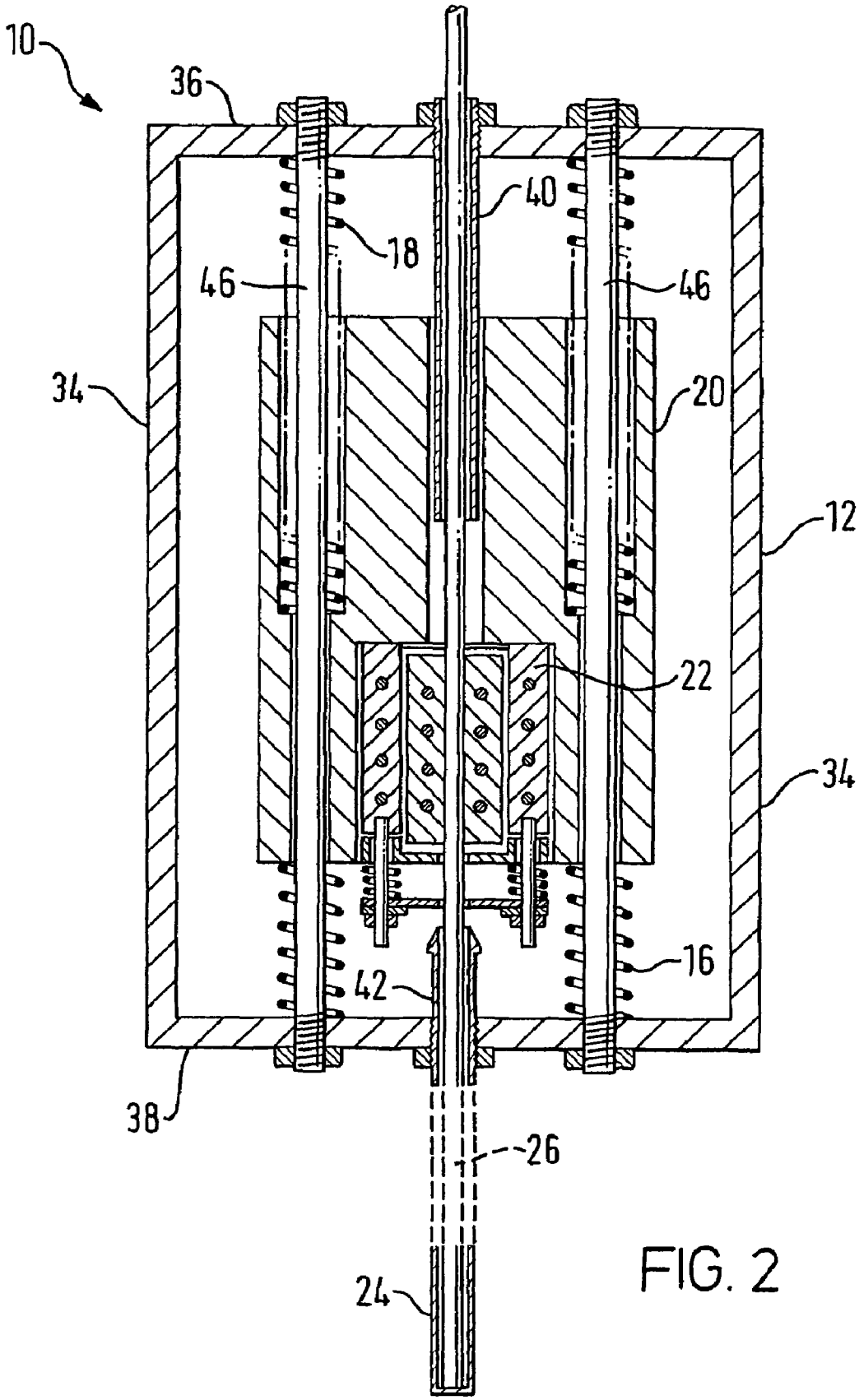
FIG. 2 is a more detailed cross-sectional view of the same part of the apparatus.

The tube 24 to be filled is positioned such that its upper end is beneath the frame 12 of the hammer-grip assembly 10, as shown in FIG. 2, and is held in position. The frame 12 oscillates up and down above the tube 24, but the average distance between the frame and the top of the tube remains the same.

Extending generally vertically through the centre of the frame 12, the hammer 20 and the grip mechanism 22 is a filling pipe 26 for the refractory insulating powder. The filling pipe 26 is normally gripped by the grip mechanism 22, but this grip can be released. Further, the grip mechanism only offers small resistance to downward sliding motion of the filling pipe.

At the start of the filling process, before any refractory powder has entered the tube 24, the filling pipe 26 is positioned within the tube 24. The lower end of the filling pipe 26 is at the bottom of the tube 24, and the heating element extends upwardly through the filling pipe. The upper end of the filling pipe is attached to a hopper 28 for refractory powder (not shown in FIG. 2), which allows the powder to flow into the filling pipe 26.

The operation of the hammer-grip assembly 10 will now be briefly described. Most of the mechanisms will be explained; however, some parts of the motion will only be mentioned, with the mechanics behind them being explained later. As mentioned above, the frame 12 is driven to move in a cyclic up-and-down motion. The hammer 20 also moves cyclically up and down, but because it is mounted on springs 16, 18 it does not move in phase with the frame, as will be explained in detail later. The motion of the frame 12 also causes the grip 22 to move upwardly, and this motion takes place while the grip 22 is gripping the filling pipe 26. As a result, the filling pipe is also moved upwardly, and this allows refractory powder to flow from the lowermost end of the filling pipe. The grip 22 and hence the filling pipe 26 are then pulled down by the frame 12 with a moderate force (as explained later) until the lower end of the filling pipe reaches the powder surface.

The powder which flows out is in an uncompacted state, and a tube filled in this way would normally need to be subjected to subsequent rolling and annealing operations as discussed above. However, in addition to the grip 22 and the filling pipe 26 being pulled downwards by the frame 12, in the hammer-grip assembly 10, the downward motion of the hammer 20 makes it impact with the grip 22 while the grip is holding the filling pipe 26. As a result, a substantial force (resulting from the momentum of the hammer) is directed downwardly through the grip and the filling pipe to the powder, and this force serves to compact the powder. Thus, the powder is compacted as the tube is filled, resulting in a filled tube which does not require a subsequent rolling step to compact the powder. Further, since the filled tube is not work-hardened by rolling, it can immediately be formed into the required shape.

When the grip 22 is pulled down by the frame 12 (by means of a mechanism which will be explained later), and is then hit by the hammer 20, there are two distinct phases of motion of the filling pipe 26. Firstly, the filling pipe is pulled down so that its lower end rests on the uncompacted powder deposited during the upward motion. Secondly, when the grip is struck by the hammer, the grip and filling pipe move downwardly, so that the filling pipe compacts the powder. The total distance moved downwardly by the end of the filling pipe 26 is less than its total upward distance when it is raised by the grip 22, the difference being the thickness of the layer of extra powder which flowed from the pipe and was compacted during the cycle. As a result, each fill/compact cycle results in the filling pipe 26 moving by a small net distance upwardly. As will be seen later, this involves a certain period of release and re-grip between the grip 22 and the filling pipe 26 in each cycle. The filling pipe 26 eventually moves all of the way out of the tube 24, and when the pipe is fully withdrawn from the tube a shut-off valve 30 (not shown in FIG. 2) in the hopper 28 is actuated to prevent further flow of refractory powder into the pipe and tube.

Figure 3:
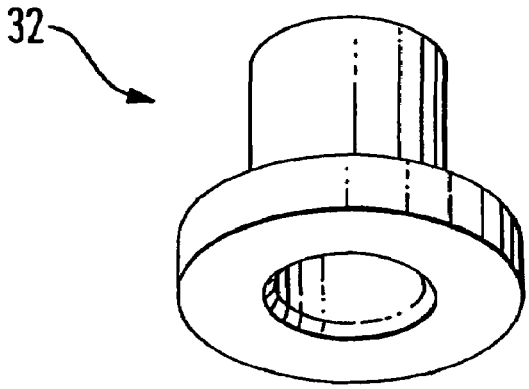
FIG. 3 is a perspective view of a ram head.

A ram head 32 (shown schematically in FIG. 3) can be provided at the lower end of the filling pipe 26. The ram head 32, which is simply inserted into the lower end of the filling pipe 26, is then the part which comes into contact with the refractory powder to compress it.

The use of a ram head has several advantages. Firstly, it is a small, easily machined component, and removes the need to machine the much larger filling pipe. It also allows a larger contact area for compression of the powder. Of course, this could also be achieved using a thick-walled filling pipe, but this could lead to problems with friction between the filling pipe and the tube, and also increase the weight of the pipe. Further, the ram head can be made of a suitable material to avoid powder contamination.

The various parts of the hammer-grip assembly 10 will now be described in greater detail.

As shown in FIGS. 1 and 2, the frame is generally rectangular, with side bars 34, a top bar 36 and a bottom bar 38. Extending vertically through the centre of the frame is the filling pipe 26.

Connected to the top bar 36 of the frame is an upper spacer 40, which extends downwardly from the top bar of the frame and surrounds the filling pipe 26 for a part of its length. Similarly, connected to the bottom bar 38 of the frame and extending upwardly therefrom is a lower spacer 42. These spacers are connected to the frame by means of nuts, so that their precise positions can be adjusted. Further, the upper and lower spacers are formed as tubes, which are sized such that the filling pipe 26 can slide freely within them. As will be seen, these spacers serve as adjustable actuators or pushers, as the appropriate end of each spacer contacts certain other parts of the assembly.

Two vertical rods 46, which extend between the top and bottom bars 36, 38 of the frame, are symmetrically disposed on either side of the filling pipe 26. Each rod passes through an arm of the inverted "U" of the hammer 20, and the hammer can slide on the rods.

Surrounding each of the rods 46 are two springs 16, 18, one of which (18) is disposed between the hammer 20 and the top bar 36 of the frame and the other of which (16) is disposed between the hammer 20 and the bottom bar 38 of the frame. The motion of the hammer 20 is determined by its mass, the motion of the frame 12 and the stiffness of the springs 16, 18. In a preferred form, the upper and lower springs have the same stiffness.

In an alternative form, the hammer can be attached to a single set of springs, mounted between the hammer and the top bar of the frame, which springs then act in compression and in tension. The springs in this case need to be securely attached to the hammer (for example, by means of screw inserts). The extension of these upper springs is then functionally equivalent to compression of the lower springs, and this provides an equivalent to providing upper and lower springs having the same stiffness.

Figure 4:
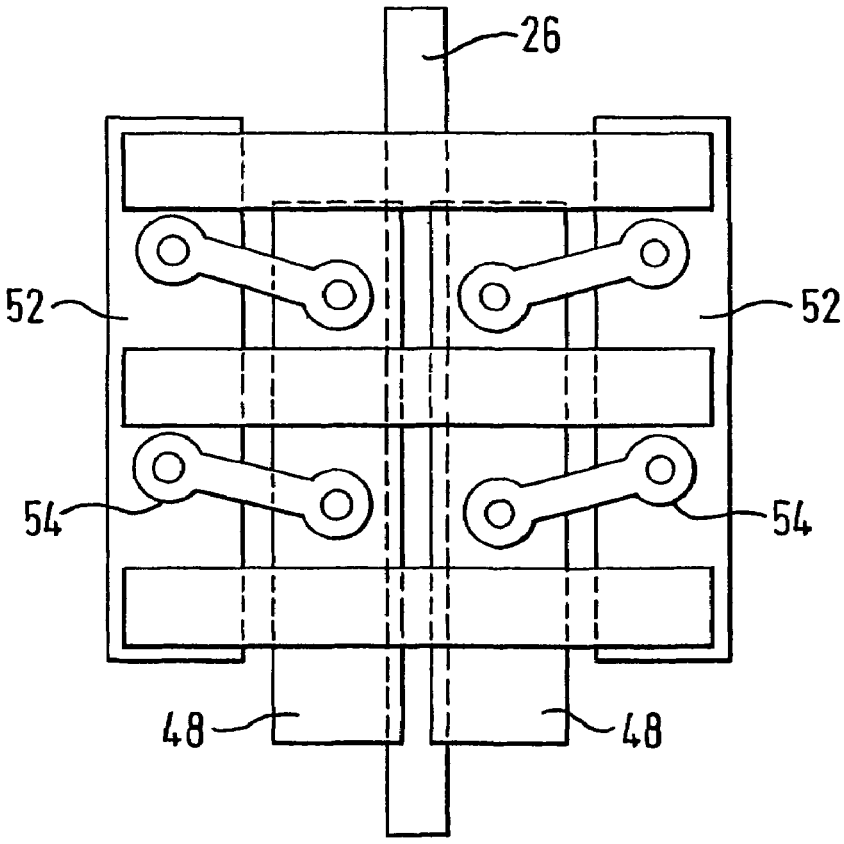
FIG. 4 is a side view of a grip assembly.

As mentioned above, a grip mechanism 22 is positioned between the arms of the hammer 20, and this grip mechanism is shown schematically in FIG. 4. The mechanism is generally symmetrical, with its axis of symmetry aligned with the centre of the filling pipe 26. The pipe itself is engaged by two grip sleeves 48, one on each side of the pipe, which have recesses 50 which fit around the pipe. Each grip sleeve 48 is attached to a block 52 by means of links 54, one end of each link being connected to one of the blocks 52 and the other end being connected to one of the grip sleeves 48. The blocks are rigidly connected to each other. Further, the grip sleeves are connected to each other by means of a slotted plate, to ensure that there is no relative vertical motion between them.

The grip sleeves 48 can be accurately machined to fit closely around the filling pipe 26. However, it is preferred for buffers to be provided on the sleeves, with the buffers being the parts that actually come into contact with the filling pipe. This allows the coefficient of friction between the grip and the filling pipe to be chosen more freely. Further, if the buffers wear, they can simply be replaced without necessitating the replacement of the grip sleeves.

Figure 5:
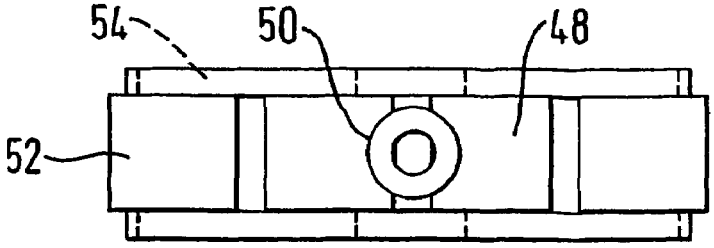
FIG. 5 is a plan view of the grip assembly.

As can be seen in FIG. 2, and in more detail in FIG. 5, at the lower end of the grip mechanism is an arrangement allowing the grip 22 to be raised by the frame 12. Projecting downwardly from each of the blocks 52 is a rod 56, which is screwed into the lower end of the block 52. Each rod 56 passes through an opening in a plate 58. The upper surface of the plate 58 rests slightly below the lower ends of the blocks 52, as can be seen from FIG. 5. However, a spring 60 is disposed between the plate 58 and the lower ends of the grip sleeves 48. Bearing against the plate 58 are two coil springs 62, each of which is disposed around one of the rods 56. Below the coil springs 62 are lever bars 64, and below these are fulcrum plates 66, on which the lever bars 64 normally rest. The fulcrum plates 66 are held in place by nuts 68 on the ends of the rods 56. The arrangement co-operates with the lower spacer 42 on the frame 12 when the frame moves upwards, to move the grip 22 and the filling pipe 26 as will be explained later.

A complete fill/compact cycle will now be described. It should be noted that FIG. 2 shows the various parts of the hammer-grip assembly at rest, and that the parts may not assume these relative positions when the hammer-grip assembly is operating.

The cycle will be assumed to run from when the frame 12 is at its bottom dead centre position, or the corresponding point in a non-sinusoidal cyclic motion. In operation, at this point in the cycle, the lower end of the filling pipe 26 (or the ram head 32, if one is used) is resting on the upper surface of the compacted powder in the tube 24, and the hammer 20 is resting on the blocks 52 of the grip 22. At the instant the frame is at bottom dead centre, the frame, the hammer 20, the grip 22 and the filling tube 26 are all at rest. Further, the upper springs 18 are nearly fully compressed between the hammer 20 and the top bar 36 of the frame, and the lower springs 16 are uncompressed. The lengths of the springs are such that there can be some play between the top of the lower springs 16 and the underside of the hammer 20 when the frame 12 is in its bottom dead centre position.

At the start of the cycle, the frame 12 begins to move upwards. This movement also causes the upper and lower spacers 40, 42 to move, as they are connected to the frame 12. The spacers slide freely over the filling pipe 26, and so at this stage the filling pipe does not move. Further, there is also no motion of the grip 22 at this stage. In addition, as a result of its inertia, the hammer 20 does not move initially. However, the upward motion of the frame pushes the lower springs 16 upwards. The upward motion of the frame also allows the upper springs 18 to uncompress to a degree.

Further upward motion of the frame 12 leads to the upper springs 18 becoming entirely uncompressed. At this stage, there is still some play between the upper ends of the lower springs 16 and the underside of the hammer 20, and so the hammer still does not move. It is only when the upper ends of the lower springs 16 have come into contact with the hammer 20 and the springs have been compressed that the hammer starts to move, and is lifted upwardly from the blocks 52 of the grip mechanism 22.

During this phase, the upward speed of the frame 12 starts to reduce, as it approaches its top dead centre position. However, as a result of its momentum upwardly, the hammer 20 tends to continue moving at the same speed. (The hammer will of course be slowed slightly by gravity; however, at the velocities achieved by the various parts of the hammer-grip assembly in practice, gravitational effects on the motion of the parts are negligible.) In addition, the lower springs 16 uncompress as the hammer moves away from the bottom bar 38 of the frame 12.

The hammer 20 is now moving upwards relative to the frame 12, and as a result of this motion the upper springs 18 start to be compressed between the upper end of the hammer 20 (moving upwardly) and the top bar 36 of the frame (slowly approaching top dead centre and then moving downwardly). The kinetic energy of the hammer 20 is stored in the upper springs 18, and the hammer decelerates. Eventually, shortly after the frame reaches its top dead centre position and starts to move downwardly, a point is reached when the hammer 20 is stationary.

During the upward motion of the hammer 20, the grip 22 is also moved upwardly. This is achieved by the upper end of the lower spacer 40 co-operating with the lever bars 64 beneath the grip 22, as will now be described.

Figure 6:
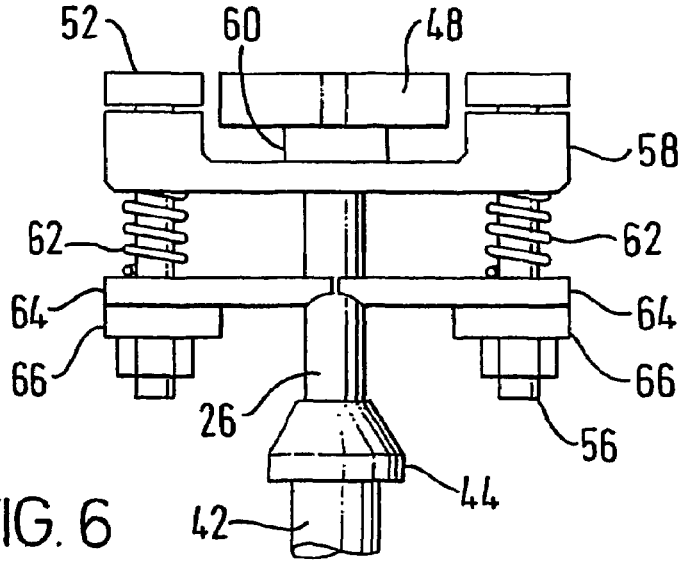
FIG. 6 is a detailed view of the lower part of the grip assembly.

As best seen in FIGS. 2 and 6, the upper end of the lower spacer 42 is conical and barbed. When the frame 12 moves upwardly, this also moves the lower spacer 42, and this movement eventually brings the upper end of the lower spacer 42 into contact with the lever bars 64. These are arranged such that the force required to make them pivot about the outer edges of the fulcrum plates 66 is less than the force required to move the grip assembly 22 upwards. Thus, the bars 64 pivot, compressing the springs 62, and this allows the conical part of the lower spacer 42 to pass between them. The bars 64 snap in behind the barbed part 44 of the spacer 42 as the spacer continues to move upwardly.

The upper end of the spacer 42 then contacts the lower surface of the plate 58. Continued upward motion of the spacer 42 compresses the spring 60 between the plate 58 and the grip sleeves 48, pushing the grip sleeves upwardly so that they firmly engage the filling pipe 26. Further upward motion of the lower spacer 42 pushes the plate 58, and thus the grip mechanism 22, upwards. This motion also pushes the filling pipe 26 upwards, lifting its lower end from the top of the compacted powder in the tube. This allows refractory powder to flow from the tube under gravity.

The upward motion of the spacer 42, and thus of the grip 22 and the filling pipe 26, continues until the frame 12 reaches its top dead centre position. Once the frame reaches this position, the spacer 42, grip 22 and filling tube 26 stop moving upwards. The direction of motion of the frame 12 then reverses, and the lower spacer 42 starts to move down.

As mentioned above, the lever bars 64 snap in behind the barbed part 44 of the lower spacer 42 during the upward motion. Thus, when the lower spacer 42 moves down, it exerts a downward force on the inner ends of the lever bars 64. However, because the lever bars 64 must now pivot about the inner ends of the fulcrum plates 66, rather than the outer ends, the force required to make the bars pivot is greater. Thus, the grip 22 assembly together with the filling pipe 26 is initially pulled downwards. After a short distance, the ram head 32 meets the upper surface of the loose refractory powder which has been flowing downwardly through the filling pipe 26 during the period since the pipe 26 was lifted off the surface of the powder compacted during the previous cycle. This leads to some consolidation of the powder in the tube, and also serves to ensure that the lower end of the filling pipe 26 or the ram head 32 is firmly seated on the upper surface of the powder.

After a short period of time, the force required to pull the grip 22 and tube 26 down further, and thus compress the powder, becomes greater than the force required to make the lever bars 64 pivot. The bars 64 then pivot, and move out from behind the barbed section 44 of the lower spacer 42, which continues to move downwardly. The filling pipe 26 remains resting on the upper surface of the powder, with the grip 22 engaged around the pipe.

Returning to the motion of the hammer 20, this was left in a stationary state, with the upper springs 18 compressed between it and the top bar 36 of the frame. However, while the hammer 20 is stationary, the frame 12 continues to move downwards. The downward motion of the frame 12 continues to compress the upper springs 18, until a point of maximum compression is reached. From this point, the upper springs 18 begin to force the hammer 20 downwardly, and this downward motion is also accelerated by the downward motion of the frame 12. The hammer 20 thus accelerates downwardly, towards the grip mechanism 22, which is gripping the filling pipe 26 which is in turn resting on top of the powder in the tube.

The hammer 20 then impacts on the top of the grip mechanism 22, pushing it downwardly. Since the grip is in engagement with the filling pipe 26, the hammer 20, grip 22 and filling pipe 26 move as one after impact. The filling pipe 26 is thus forced downwardly, to compact the powder. The kinetic energy of the hammer 20 is absorbed by this compacting of the powder.

Ideally, the hammer 20 impacts on the grip mechanism 22 after the upper springs 18 have become fully uncompressed, and before the hammer comes into contact with the lower springs 16. In this situation, the hammer is travelling at its maximum velocity (and thus has maximum momentum) at impact.

The hammer 20, grip 22 and filling pipe 26 are now stationary (apart from a tiny initial bounce of the hammer, the amplitude of which is negligible compared to the other motions in question). However, the frame 12 continues to move downwardly into its bottom dead centre position. As the frame 12 moves to this position, the upper springs 18 become partly compressed (which involves them being less compressed than the "position of maximum compression" mentioned earlier).

As the upper springs 18 approach their partly compressed position, the lower end of the upper spacer 40 comes into contact with the upper ends of the grip sleeves 48. This pushes the grip sleeves 48 downwardly, against the force of the spring 60, and so opens the grip 22, releasing the engagement between the grip and the filling pipe 26. Further downward motion of the frame 12 into its bottom dead centre position pushes the grip mechanism 22 down slightly along the filling pipe 26. The distance which the grip moves along the filling pipe is equal to the thickness of compacted powder added during the cycle (ie the thickness of the powder deposited through the ram head in the fill/compact cycle, less the reduction in thickness of the layer of powder during its compaction). The hammer 20 remains resting on the grip mechanism 22, since it is also pushed down by the upper springs 18.

It will be seen that the initial upward motion of the frame 12 causes the lower end of the upper spacer 40 to move away from the upper end of the grip sleeves 48. This allows the spring 60 between the plate 58 and the lower ends of the grip sleeves 48 to urge the grip sleeves upwards, into engagement with the filling pipe 26. Strictly speaking, this pre-loading part of the operation should have been discussed at the start of the cycle; however, it is considered rather clearer to discuss it at this point.

It is possible to eliminate the play between the upper and lower springs 16, 18 and the hammer 20, and in practice this may be desirable, as excessive play can lead to the generation of unwanted noise as the hammer and springs hit each other. In a playless version of the apparatus, the lengths of the springs are such that both the upper and lower springs can be in contact with the frame and the hammer, but not compressed. In the cycle described above, during the initial upward motion of the frame, the upper end of the lower spring would come into contact with the hammer at the same time as the upper spring became fully uncompressed.

It is an important advantage of the described embodiment that the impact force of the hammer 20 is not transmitted to the frame or the drive. The force of impact passes downwardly through the grip mechanism 22 and the filling pipe 26, via the ram head 32 if applicable, to the powder and the tube 24; the frame itself does not "feel" the impact. The only resistance to motion which the frame experiences results from the compression of the springs. As well as conserving power, this reduces the loading on the apparatus, and so helps to increase its operational lifespan. Since the impact force is only felt by the hammer, the powder and the portion of the machine on which the heater tube being filled rests, the frame can be made of more slender parts, thus reducing the weight of the machine, the power (and weight) of the drive required, and the cost.

The filling pipe 26 is lifted a small distance out of the tube 24 in each fill/compact cycle, the distance corresponding to the thickness of the layer of compacted powder deposited in each cycle. If for some reason powder is not deposited during a cycle (for example, if the pipe 26 is blocked, or if the hopper 28 is exhausted), then the pipe will finish the cycle in the same position as it started. This is because the filling pipe is firmly pulled down onto the surface of the powder by the grip 22 and the lower spacer 42 as the frame 12 moves downwardly. If powder is not deposited, then the height of the surface of the powder will not change over the course of the cycle, and so the pipe 26 will be pulled back to its original positions. The lack of overall upward movement of the pipe 26 can serve to alert an operator of the filling machine that something is amiss. Furthermore, the overall rate of upward movement is automatically self-adjusted according to both the actual rate at which powder is deposited, and the density of compaction achieved. The system therefore effectively provides closed-loop feedback where the controlled parameter is the density of compaction, set to a desired value by the impact force achieved, which as mentioned earlier is itself settable by the combination of drive frequency, stroke and geometrical parameters of the system.

Figure 7:
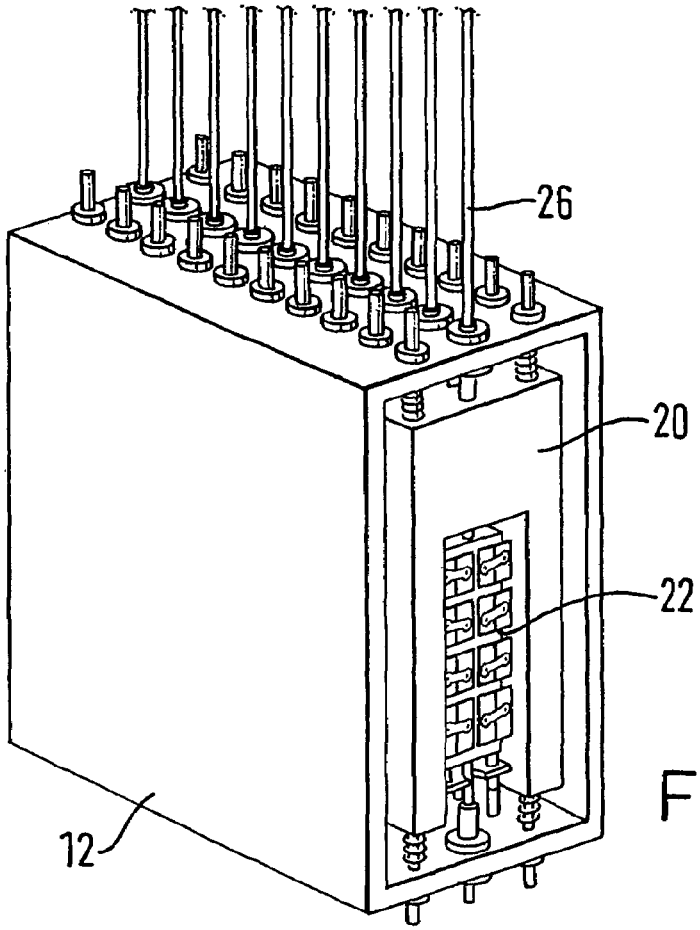
FIG. 7 is a perspective view of a group of hammer-grip assemblies in a single frame.

The hammer-grip assembly 10 described above fills a single heating tube with refractory powder. In practice, several hammer-grip assemblies will be used simultaneously to fill a number of tubes (for example, 6, 10, 12 or 24) at the same time. The hammer-grip assemblies can have a common frame, as shown in FIG. 7; however, each assembly has its own hammer, grip mechanism and filling pipe.

Figure 8:
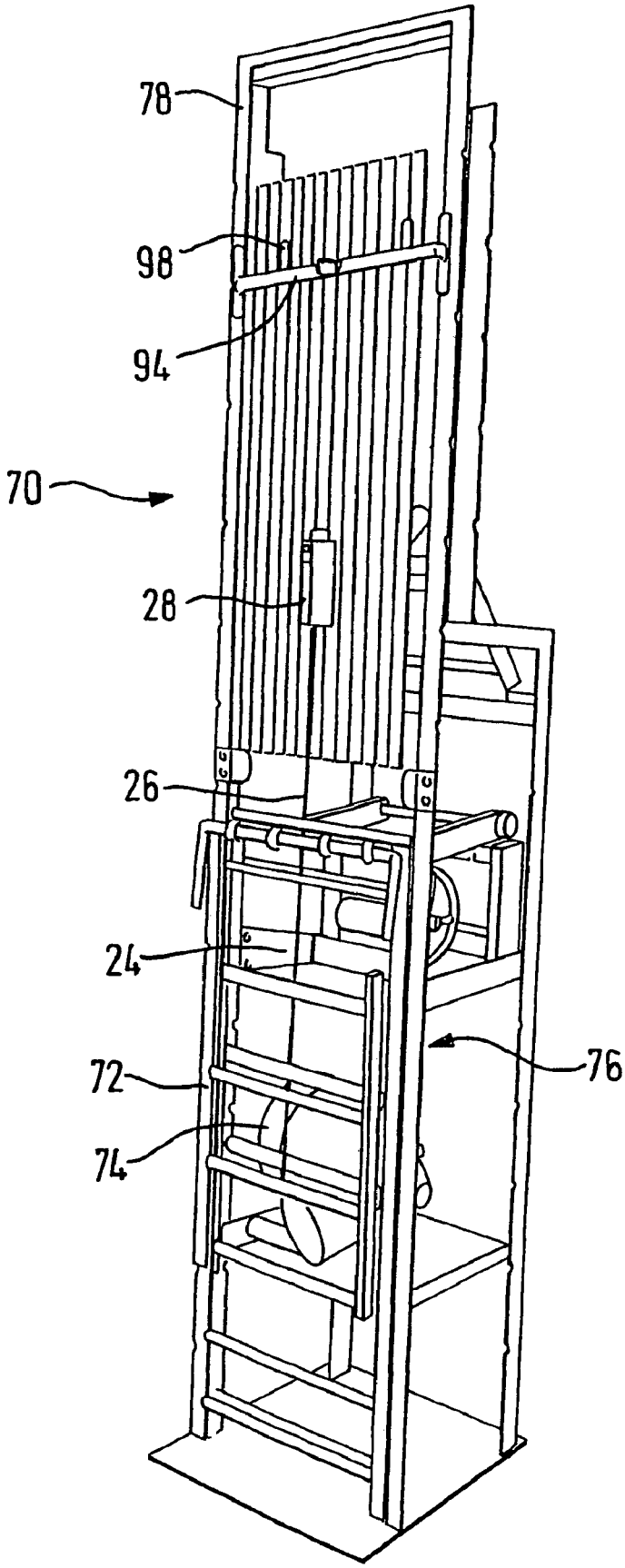
FIG. 8 is a schematic view showing a tube filling machine.

The frame, carrying one or more hammer-grip assemblies 10, is mounted into a filling machine 70, shown very schematically in FIG. 8. As can be seen, the machine 70 is generally in the form of an elongate frame 72.

In the lower part of the frame 72 of the machine 70 is an electric motor 74, which is used to supply the motive power to the frame 12 of the hammer-grip assemblies 10. The motor 74 drives an eccentric shaft via a belt-drive system 76, and the motion of the eccentric shaft is used to produce the cyclic up-and-down motion of the frame 12. Although the eccentric shaft system is the simplest arrangement for producing cyclic motion, it is not necessarily the best. Investigations have shown that a "quick return" mechanism (ie an inverted sliding crank arrangement as commonly used in shaping machines) or a "knuckle joint" mechanism (commonly found in high-speed mechanical presses) give higher impact speed with no extra power expenditure.

A rack of heater tubes which are to be filled by the machine are attached to the front of the machine frame 72. This allows empty tubes to be inserted and filled tubes to removed easily. The tubes are held in a vertical position, and are prevented from moving horizontally and vertically. It is important that the tubes do not move out of vertical alignment, as this could cause problems in withdrawing the filling pipe. Further, it is important for the tubes to be held firmly as they will experience the full force of the hammer impacting on the powder.

It is also important for the electrical heating elements within the tubes to be held in position during the filling process. The pins at the lower end of the tube are held in place by the frame. The upper end of the electrical heating element is secured to a long pin, which passes through the length of the filling pipe, and is secured to the upper end of the machine frame 78. The filling pipe 26 is dimensioned such that it can slide relative to the coiled electrical heating element without causing any damage.

Figure 9:
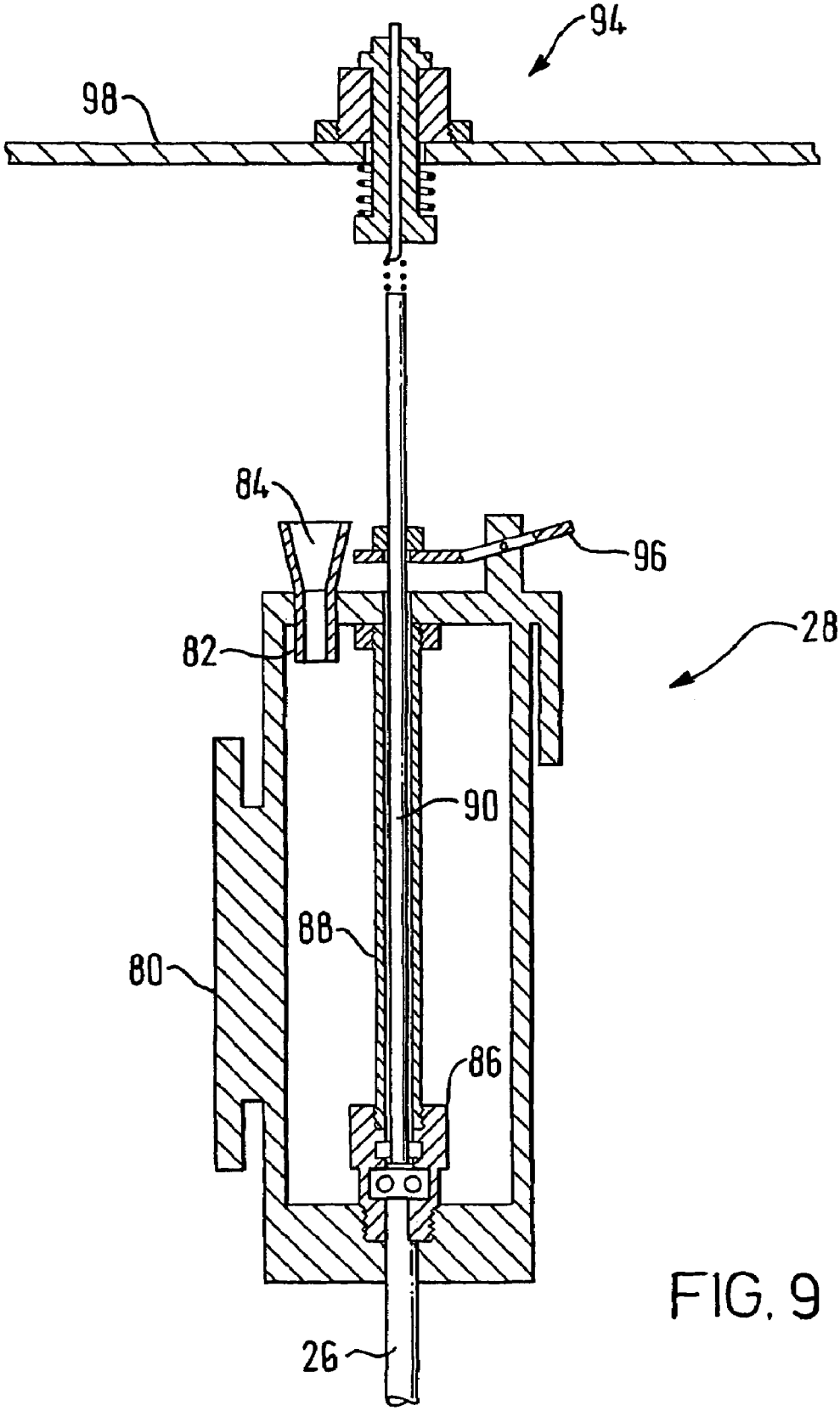
FIG. 9 is a cross-sectional view of a hopper used in the tube filling machine.

As mentioned previously, a hopper 28 is attached to the upper end of the filling pipe 26. Each pipe 26 is provided with its own individual hopper 28, which holds enough refractory material to fill a tube 24. A cross-sectional view of a hopper is shown in FIG. 9.

Extending downwardly from the underside of the hopper 28 is the filling pipe 26. The upward motion of the filling pipe 26 also moves the hopper upwardly 28. The hopper has a guide lug 80, which fits into a slot on the filling machine 70, to ensure that its motion is vertical.

In the upper wall of the hopper 28 is an opening 82, in which a filling cone 84 is positioned. The hopper 28 can be refilled with refractory powder through this opening, and this will be described in more detail later.

Directly above the filling pipe 26, and fitted into the lower wall of the hopper 28, is a valve body 86. Extending upwardly from the valve body 86 to the upper wall of the hopper is a guide sleeve 88, inside which is disposed a valve sleeve 90 in the form of an elongate tube. The valve sleeve 90 extends upwardly from the top of the hopper 28.

The valve body 86 and the valve sleeve 90 cooperate to form the shut-off valve 30, which stops the flow of material from the hopper 28 once the hopper has reached its top position (corresponding to the state where the heater tube 24 has been completely filled). This will be described in more detail with reference to FIGS. 10 and 11.

Figure 10:
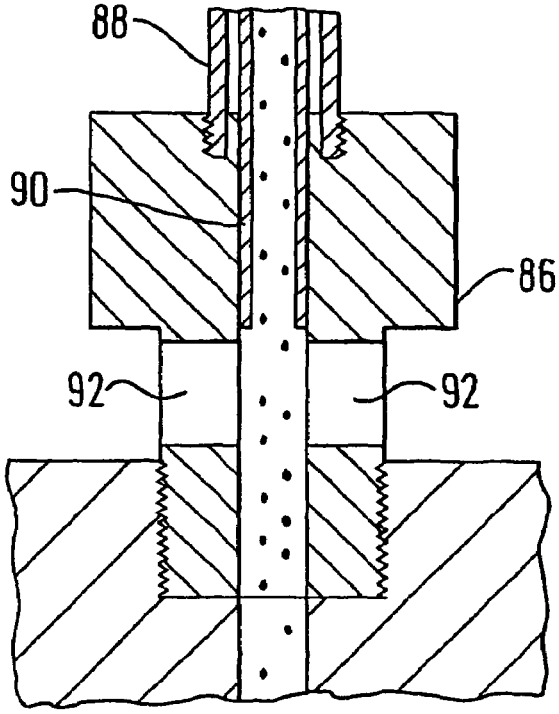
FIG. 10 is a cross-sectional view of a shut-off valve in the hopper in an open position.

As can be seen from FIG. 10, the valve body 86 is in the form of a tubular member, with an upper larger diameter section and a lower smaller diameter section. The lower end is screwed into the lower wall of the hopper 28. Lateral powder flow passages 92 are formed as holes (typically rectangular) in the side wall of the valve body 86, spanning the whole height of its lower diameter section. It will be appreciated that the openings do not span the whole circumference (ie they are a partial annular orifice), leaving ample sectors (the remainder of the circumference) as a wall forming the structure of the valve. The annular flow orifice allows material at the bottom of the hopper 28 to flow into the tubular member.

The dimensions of the passages (the annular orifice) are such that when the hopper is stationary, no powder will flow. When the hopper vibrates, powder flow will commence, and the hopper is driven to vibrate as a result of being in contact with the filling pipe 26. When vibration stops, powder flow ceases. The dimensions of the passages are sufficiently large so as to avoid any risk of powder blockage. Their size is however matched to the vibration characteristics of the machine and to the properties of the powder such as particle size, sorting and angularity in such a way that they control the rate of flow when the hopper is vibrated. After flowing through the passages, the material then flows down under gravity, into the filling pipe 26.

Figure 11:
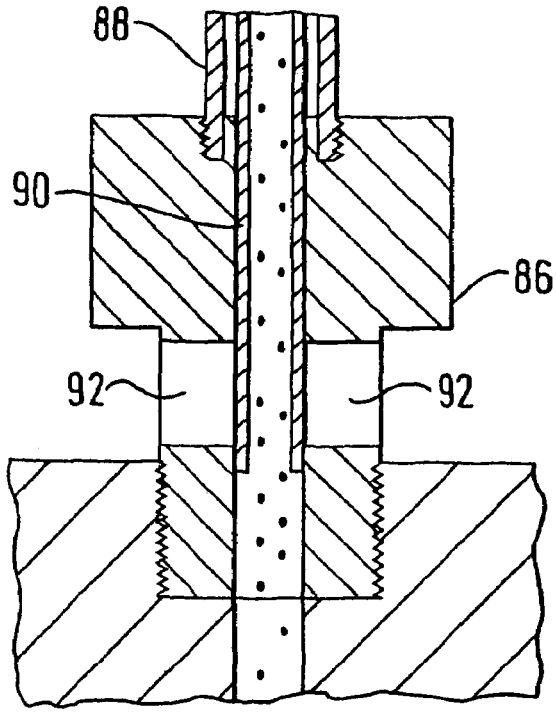
FIG. 11 is a corresponding view of the valve in a closed position.

It will of course be appreciated that the orifices can take any form, as long as they allow powder to flow through them at a sufficient rate under vibration. The valve can function in this manner because the upper surface which defines the passage extends laterally further into the bulk of the powder than the lower surface (as can be seen from FIG. 11). It will also be appreciated that the flow rate of the powder is primarily governed by the dimensions of the annular exit created by the outlet orifice and the supporting pin which passes through it In order to close the shut-off valve 30 definitively, rather than merely relying on the absence of vibration, the valve sleeve 90 is moved downwardly. This blocks off the lateral passages 92, and prevents any further material from flowing into the valve body 86. This is shown in FIG. 11. It will be appreciated that, since the valve sleeve 90 is housed in the guide sleeve 88, the material in the hopper 28 will not normally come into contact with the valve sleeve 90, and so there is less chance of the valve malfunctioning (for example, not closing when it is meant to) as a result of contamination or unwanted material ingress.

The valve sleeve 90 is normally held in its "up" position (as shown in FIGS. 10 and 11), allowing material to flow onto the valve body 86. When the upper end of the valve sleeve 90 comes into contact with an upper limit stop 94, the sleeve 90 is pushed down to close the valve 30. The valve sleeve can be lifted back into its "up" position by means of a lever 96.

It will be appreciated that the hoppers 28 and their associated shut-off valves 30 are all completely independent. The flow of refractory material into each filling pipe 26 is only cut off when the hopper 28 associated with that filling pipe 26 reaches its top position. The flow into that filling pipe 26 is then cut off without affecting flow in any of the other filling pipes.

The upper limit stops 94 are mounted on a crossbar 98 on the machine frame 72, whose vertical position can be varied to allow tubes of different lengths to be filled. Further, each stop 94 can detect when the valve sleeve 90 has come into contact with the stop, and when all of the sleeves 90 have contacted the stops 94, the machine motor 74 can be shut down.

After a tube 24 has been filled with refractory material, it is removed and an empty tube is inserted. However, before the new tube can be filled, the hoppers 28 must be refilled with sufficient refractory material. This could be done by filling each hopper individually; however, this is not a particularly efficient approach. In the preferred embodiment of the machine, a hopper charger 100, which can refill all of the hoppers simultaneously, is provided above the hoppers 28.

Figure 12:
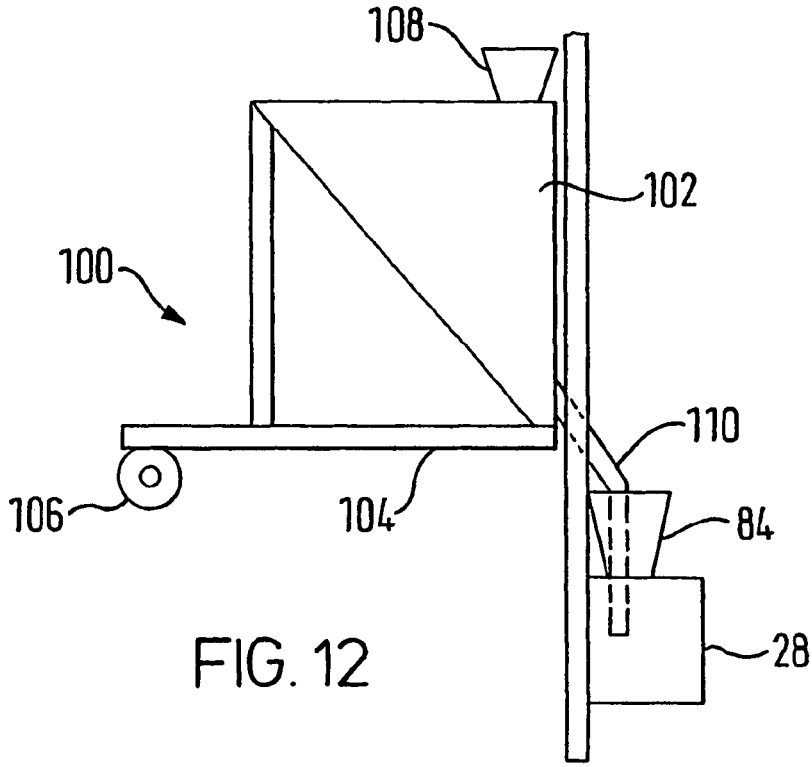
FIG. 12 is a view of a hopper charger.
Figure 13:
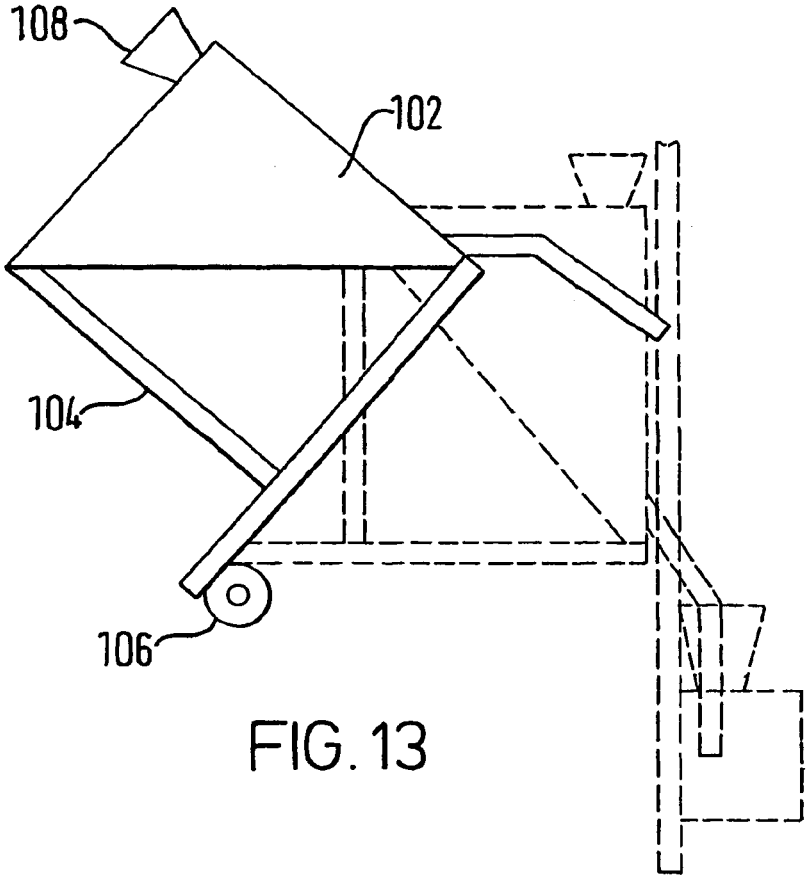
FIG. 13 is a view of the hopper charger in an alternate position.

The hopper charger 100 is shown in FIGS. 12 and 13. It comprises a container 102 with a triangular cross-section, mounted on a frame 104 which is rotatable around a shaft 106. In the top wall of the container 102 is a filling funnel 108 for refilling the hopper charger 100. Extending from the side wall of the container are a plurality of filler tubes 110, one for each hopper 28.

When the hopper charger 100 is pivoted to its pouring position (shown in FIG. 12 and in phantom in FIG. 13), the filler tubes 110 enter the filling cones 84 of the hoppers 28. Powder flows through the filler tubes 110 into the hoppers 28.

When the level of powder in the hoppers 28 reaches the lower end of the filling tubes 110, powder flow ceases. The hopper charger 100 is then pivoted to its rest position, shown in full lines in FIG. 13. In this position, the ends of the filler tubes 110 are withdrawn from the hoppers 28, as best seen in FIG. 13, to allow the hoppers to move up and down freely.

Because of the arrangement of the filler tubes 110, there is no powder flow from the hopper charger 100 as it is pivoted into its rest position, nor when the charger is in its rest position. Further, the position of the filling funnel 108 allows the hopper charger 100 to be refilled when it is in its rest position. Ideally, the hopper charger 100 has sufficient capacity to recharge the hoppers 28 several times before it needs refilling itself.

The operation of the filling machine will now be briefly described.

Firstly, the hopper charger 100 is filled with refractory powder when in its rest position. Empty heater tubes 24 are positioned in the rack on the machine frame 72, and a filling pipe 26 is positioned around the electrical heating elements, which are secured in position by means of pins. The filling pipes 26 are positioned so that their bottom ends are adjacent the bottoms of the tubes 24 to be filled.

The hopper charger 100 is moved to its pouring position, to fill the hoppers 28 with refractory powder. When the hoppers are full, the hopper charger is moved back to its rest position. The electric motor 74 is then switched on, to drive the frame 12 of the hammer-grip assemblies 10 in a cyclic up-and-down motion. This causes the hammer-grip assemblies 10 to gradually fill the heater tubes 24 with compacted refractory material.

As the heater tubes 24 are filled, the filling pipes 26 are gradually withdrawn from the tubes with no external control system, by virtue of the feedback from each added layer of compacted powder and its resistance to the impact force as governed by its density causing the grip assembly to slip by the correct distance, thus pushing the hoppers 28 upwardly. If one of the pipes requires less powder feed per cycle of compaction, then the pipe's gradual upward motion is slowed down. Should a pipe become blocked, or the fresh powder feed be hindered for any reason, then the gradual upward motion of the pipe ceases, and an operator of the machine can observe this and take the appropriate action.

Once a tube 24 is completely filled, the hopper 28 is pushed upwardly into a position where the valve sleeve 90 of the shut-off valve 30 is pushed down, to prevent further flow of refractory material into the pipe 26 and tube 24. This is also sensed by the upper limit stop 94. When all of the tubes are filled, as sensed by the upper limit stops, the electric motor 74 is switched off, and the filled tubes can be removed.

This cycle can then be repeated as necessary, to fill further heater tubes.

It will be appreciated that the forces required to compact the powder, and the amount of powder required to fill the tube, will vary depending on the size and diameter of the tubes. The impact force will depend on the mass of the hammer, the stiffnesses of the springs, and the frequency and amplitude of the up-and-down motion of the frame, and any or all of these can be varied to vary the impact force. In practice, a hammer-grip assembly will be designed for use with a particular size of tube, and the machine can be adapted to fill different sized tubes by simply replacing the hammer-grip assemblies, or by varying the frequency, amplitude and nature of the up-and-down cycle motion.

Further, although the above description has concentrated on the use of a hammer to compact the powder, it will be appreciated that the use of a grip mechanism mounted on a reciprocating frame, without a hammer, can also provide an advantageous method of filling a pipe, as it provides for feedback.

The invention claimed is:

1. A method of filling a tube with a powder, comprising the steps of:

i) positioning said tube generally vertically;

ii) inserting a filling pipe into said tube;

iii) allowing powder to flow into said filling pipe;

iv) moving said filling pipe upwardly a small distance to allow powder to flow from its lower end into said tube;

v) moving said filling pipe downwardly to contact against and rest on the powder in said tube;

vi) repeating steps (iv) and (v) until the tube is filled with powder; and vii) stopping further flow of powder into said pipe.

2. A method as claimed in claim 1, wherein said filling pipe is urged against said powder after being moved downwardly in step (v) so as to compact the powder in said tube.

3. A method as claimed in claim 2, wherein said pipe is pushed downwardly by means of an impact.

4. A method as claimed in claim 3, wherein said pipe is moved upwardly and downwardly by means of a grip mechanism, which can selectively grip said pipe.

5. A method as claimed in claim 4, wherein said impact is achieved by impacting a hammer member on said grip mechanism while said grip is gripping said pipe.

6. A method as claimed in claim 4 or claim 5, wherein said grip is forced to move relative to said pipe after impact.

7. A method as claimed in claim 6, wherein the distance which said grip is forced to move relative to said pipe is controlled by feedback from the filling and compacting process itself, in that the distance which said grip moves relative to said pipe is determined by the thickness of compacted powder deposited in the previous cycle and the density to which it is compacted.

8. A method as claimed in claim 6, wherein said grip and said hammer member are mounted in a frame, said frame being driven to move up and down, the movement of said frame causing motion of the grip mechanism and the hammer member.

9. A method as claimed in claim 5, wherein the design of the dynamics of motion of said hammer member inhibits the impact required to compact the powder from being felt by said frame.

10. A method as claimed in claim 1, wherein the flow of powder in step (iii) commences with vibration of said filling pipe and ceases when vibration of said filling pipe ceases.

11. A method as claimed in claim 1, wherein the rate of powder flow in step (iii) is controlled by vibration characteristics of the filling apparatus, as well as by flow characteristics of the powder itself.

12. A method as claimed in claim 1, wherein said flow of powder is stopped in step (vii) by operation of a valve actuated by upward motion of said filling pipe.

13. A method as claimed in claim 12, wherein a hopper for powder is connected to the top of said filling pipe, and an upward motion of said hopper serving to actuate said valve.

14. A method of filling a tube with a powder, comprising the steps of:

i) positioning said tube generally vertically;

ii) inserting a filling pipe into said tube;

iii) allowing powder to flow into said filling pipe;

iv) moving said filling pipe upwardly a small distance by means of a grip mechanism to allow powder to flow from a lower end of said filling pipe into said tube;

v) moving said filling pipe downwardly by said grip mechanism to contact against and rest on the powder in said tube;

vi) impacting said grip member with a hammer so as to compact the powder beneath the filling pipe;

vii) repeating steps (iv), (v) and (vi) until the tube is filled with powder; and viii) stopping further flow of powder into said pipe.

15. A method as claimed in claim 14, wherein said grip and said hammer are mounted in a frame which is driven cyclically up and down, the motion of said frame causing motion of said grip mechanism and said hammer.

16. Apparatus for filling a tube with a powder, comprising:

a structure for supporting a tube to be filled;

a filling pipe into which powder is flowable, a mechanism for moving said filling pipe upwardly to allow said powder to flow into said tube;

a mechanism for moving said filling pipe downwardly to contact against and rest on the powder in said tube; and a hammer for imparting an impact force to said filling pipe when it rests on the powder in said tube.

17. Apparatus as claimed in claim 16, wherein said mechanism and said hammer are mounted in a frame which is connected to a drive member enabling it to be driven in a cyclic up-and-down motion, said hammer being mounted in said frame on springs, such that the up and down motion of said frame causes said hammer to move up and down and to impart said impacting force to said pipe.

18. Apparatus as claimed in claim 16, wherein a hopper for powder is connected to the upper end of the filling pipe.

19. Apparatus as claimed in claim 18, wherein said hopper includes a valve such that powder flow will commence with vibration of said filling pipe and will cease when vibration of said filling pipe ceases.

20. Apparatus as claimed in claim 19, wherein the rate of powder flow through said valve is controlled by the vibration characteristics of said filling apparatus as well as by flow characteristics of said powder.

21. Apparatus as claimed in claim 20, wherein said valve is provided in the lower region of the hopper, and has at least one powder passage defining orifice formed therein in communication with the inside of the filling pipe, the orifice being at least partially defined by an upper surface and a lower surface, the upper surface of said orifice defining the passage extending laterally further into the bulk of the powder than the lower surface of said orifice.

22. Apparatus as claimed in claim 21, wherein said hopper includes a shut-off valve for preventing flow of powder into the pipe after the tube has been filled, said valve being actuated by upward motion of said hopper.

23. Apparatus as claimed in claim 22, wherein said shut-off valve comprises a valve body in the bottom of the hopper, and a valve sleeve movably mounted in said hopper, upward motion of said hopper after said tube is filled serving to push said valve sleeve down into said valve body to close said shut-off valve.

24. Apparatus as claimed in claim 23, wherein said shut-off valve and said valve enable powder flow to commence with vibration of said filling pipe and to cease when vibration of said filling pipe ceases are of a unitary valve construction.

* * * * *